US010183457B2

(12) United States Patent
Mies et al.

(10) Patent No.: US 10,183,457 B2
(45) Date of Patent: Jan. 22, 2019

(54) SYSTEM AND METHOD FOR EXCHANGING VERTICALLY SEGMENTED ROTOR SEGMENTS ON A ROTARY TABLET PRESS

(71) Applicant: Korsch AG, Berlin (DE)

(72) Inventors: Stephan Mies, Berlin (DE); Ingo Klaer, Berlin (DE); Michael Matthes, Dallgow-Doeberitz (DE)

(73) Assignee: KORSCH AG, Berlin (DE)

( * ) Notice: Subject to any disclaimer, the term of this patent is extended or adjusted under 35 U.S.C. 154(b) by 403 days.

(21) Appl. No.: 14/891,329

(22) PCT Filed: May 16, 2014

(86) PCT No.: PCT/EP2014/060111
§ 371 (c)(1),
(2) Date: Nov. 14, 2015

(87) PCT Pub. No.: WO2014/184354
PCT Pub. Date: Nov. 20, 2014

(65) Prior Publication Data

US 2016/0144587 A1 May 26, 2016

(30) Foreign Application Priority Data

May 16, 2013 (DE) ..... 10 2013 105 048
Jul. 11, 2013 (EP) ..... 13176041

(51) Int. Cl.
*B30B 15/02* (2006.01)
*B30B 11/08* (2006.01)

(52) U.S. Cl.
CPC ..... *B30B 15/028* (2013.01); *B30B 11/08* (2013.01); *B30B 15/026* (2013.01)

(58) Field of Classification Search
CPC ..... B28B 5/06; B28B 17/009; B30B 11/08; B30B 15/026; B30B 15/028; Y10T 29/49819; Y10T 29/49895; Y10T 29/53548
See application file for complete search history.

(56) References Cited

U.S. PATENT DOCUMENTS 4,589,831 A * 5/1986 Weggel ..... B30B 11/165 425/195
5,215,513 A * 6/1993 Maynard ..... B21D 28/12 483/29
7,491,052 B2 2/2009 Hinzpeter et al.
7,641,466 B2 1/2010 Malick et al.
(Continued)

FOREIGN PATENT DOCUMENTS

CN 2014828154 5/2016
DE 4107508 C1 3/1992
(Continued)

OTHER PUBLICATIONS

Translation of EP0503140, generated Dec. 12, 2017.*

*Primary Examiner* — Matthew P Travers
(74) *Attorney, Agent, or Firm* — Agris & Von Natzmer, LLP; Joyce Von Natzmer

(57) ABSTRACT

Disclosed is a system and a method for exchanging vertically segmented rotor segments (16) on a rotary tablet press (34). The system comprises a rotor (10) comprising at least two vertically segmented rotor segments (16), a transfer unit (36) and an assembly carriage (38).

20 Claims, 3 Drawing Sheets

(56) References Cited

U.S. PATENT DOCUMENTS

| | | | |
|---|---|---|---|
| 2003/0042639 | A1 | 3/2003 | Christiaens et al. |
| 2003/0101843 | A1 | 6/2003 | Hinzpeter et al. |
| 2009/0191297 | A1 | 7/2009 | Malick et al. |
| 2013/0152126 | A1 | 6/2013 | Shkedi |
| 2016/0144587 | A1 | 5/2016 | Mies et al. |

FOREIGN PATENT DOCUMENTS

| | | | | |
|---|---|---|---|---|
| EP | 0503140 | A2 * | 9/1992 | ..... B28B 5/12 |
| EP | 1316411 | A2 | 6/2003 | |
| EP | 1316411 | A2 | 6/2003 | |
| EP | 2082867 | A2 | 7/2009 | |
| EP | 20140724747 | | 5/2016 | |
| JP | S5577529 | U | 5/1980 | |
| JP | S56131924 | U | 10/1981 | |
| JP | H03116223 | U | 12/1991 | |
| JP | H0475691 | U | 7/1992 | |
| JP | H05131294 | A | 5/1993 | |
| JP | H05185295 | A | 7/1993 | |
| JP | H0671497 | A | 3/1994 | |
| JP | H0938796 | A | 2/1997 | |
| JP | 2003080267 | A | 3/2003 | |
| JP | 2009248141 | A | 10/2009 | |
| JP | 2016530998 | A | 10/2016 | |
| KR | 20160009042 | | 1/2016 | |
| WO | 03/020499 | A1 | 3/2003 | |
| WO | 03020499 | A1 | 3/2003 | |
| WO | 2009/112886 | A1 | 9/2009 | |
| WO | 2009112886 | A1 | 9/2009 | |

* cited by examiner

SYSTEM AND METHOD FOR EXCHANGING VERTICALLY SEGMENTED ROTOR SEGMENTS ON A ROTARY TABLET PRESS

CROSS-REFERENCE TO RELATED APPLICATIONS

This is the U.S. national stage of International application PCT/EP2014/060111, filed May 16, 2014 designating the United States and claims priority to German application DE 10 2013 105 048.4, filed May 16, 2013 and European application EP 13176041.5, filed Jul. 11, 2013.

The invention relates to a system for exchanging vertically segmented rotor segments on a rotary tablet press, said system comprising at least two vertically segmented rotor segments, a transfer unit and an assembly carriage. In another aspect, the invention relates to a method for installing and dismantling vertically segmented rotor segments.

In the prior art, there are known rotary tablet presses with which solid particles are pressed in large numbers from dry, powdered, free-flowing and bindable pressing compounds with the help of press tools and the corresponding pressure stations. In the pharmaceutical industry, rotary tablet presses are used to produce tablets. In the chemical industry, for example, cleaning tablets for washing machines and dishwashers are produced using these machines, but rings for production of alkaline batteries are also produced in this way. In the technical industry, these presses have proven suitable in the production of pressed tablets of metal powder for sintered parts and oxide ceramics for catalysts, for example.

Rotary tablet presses usually include a rotor, which has a die table with a number of dies arranged on a pitch circle. Each die has an upper punch and a lower punch, which are guided by means of guide curves. The upper and lower punches are supported in corresponding guides, which are part of the rotor. A material to be pressed can be filled into the dies through at least one filling device. The upper and lower punches are guided via a filling station, a metering station, a prepressure station and a main pressure station.

One disadvantage of the devices known in the prior art is that a tool change is very time-consuming on a rotary tablet press. A tool change, i.e., replacing the press tools, in particular the upper and/or lower punches and/or dies and/or die inserts but also central mandrels and central mandrel holders for production of ring-shaped pressed bodies, is performed during a break in production, i.e., when the rotary tablet presses are shut down. The larger the rotary tablet press and the more tools there are to be replaced, the longer the shutdown time. Alternatively, in the prior art the entire rotor may be replaced in order to shorten the downtime (exchangeable rotor). As a result, in particular in very large machines, in which the rotor weight may be from 1000 to 3500 kg, this means that very great weights must be moved in the case of larger rotary tablet presses and with larger diameters of the rotor of the rotary tablet press.

JP H06 71497 A, EP 2 082 867 A2, EP 1 316 411 A2, JP H04 75691 U and JP H05 131294 describe rotary tablet presses having segmented rotors or die tables. JP H06 71497 A describes a die configuration which makes it possible to assemble the press tools of a rotary tablet press. EP 2 082 867 A2 describes a rotary tablet press, in which the die table consists of at least two ring segments. EP 2 082 867 A2 in particular discloses a mounting device for the ring segments on the rotor of the rotary tablet press by means of driven tension elements. EP 1 316 411 A2 describes a rotor of a rotary tablet press which also has a segmented die table as well as a mounting device for the die segments on the body of a lower punch guide of the rotary tablet press. JP H04 75691 U describes a segmented rotor. JP H05 131294 A describes a segmented die table, which is mounted on a central rotor unit.

One disadvantage of these devices is that, in each case, additional components of the presses, in particular the cams for controlling the upper and lower punches, must be removed in order to dismantle or clean the rotor or die segments. Thus, the rotor change or cleaning is associated with downtimes for the machine. Furthermore, the devices described here tend to be small, so that the masses to be moved when changing the rotor are comparatively small.

WO 03/020499 A1, WO 2009/112886 A1 and JP 2009 248141 describe lifting and moving tools and transport devices, but the rotor is either dismantled as a whole (exchangeable rotor) or in a manner that necessitates further dismantling of additional components of the rotary tablet press, for example. The lifting and moving tools, which are also described in the prior art, are suitable in particular for removing small, lightweight exchangeable rotors from the rotary tablet press. These tools are not suitable for large exchangeable rotors or heavy rotor segments of large presses.

WO 03/020499 A1 describes a rotary tablet press and a method for cleaning same. This describes a pivot arm for transfer of a complete press unit to a carriage, but in WO 03/020499 A1 the entire press unit is dismantled from the rotary tablet press. This includes a die table, upper and lower punches, a filling device and a scraping device for the pressed tablets. Complete removal of the press unit is associated with the disadvantages described above with regard to personnel and labor time and requires moving, transporting and storing the press unit as a whole, which weighs several hundred kg but less than 1000 kg.

WO 2009/112886 A1 also describes a rotary tablet press and a method for replacing rotary components. However, in this patent application, the rotor is not broken down by vertical segmentation but instead is constructed with horizontal separation. WO 2009/112886 A1 describes how the individual rotor components, in particular the die table and an upper and lower punch guide, can be separated from one another. However, one disadvantage of this type of dismantling is that it is still necessary to dismantle additional components of the rotary tablet press, which has negative effects on the time consumed and the use of personnel in replacing a rotor. A complicated time-consuming adjustment of these components is necessary in particular. The rotors described in the prior art are relatively small rotors with a pitch circle diameter of approximately 420 to 500 mm. The individual weight of the parts to be moved is therefore only approximately 60 to 100 kg.

JP H05 185 295 A discloses a rotary tablet press, in which the upper and lower punches, i.e., the press tools, are replaceable. One disadvantage of this device is that it does not describe how the rotor can be removed for cleaning purpose without removing additional components of the rotary tablet press.

The object of the present invention is therefore to provide a device and a method which will not have the disadvantages and shortcomings of the prior art and will offer an improved solution for performing a quick tool change on a rotary tablet press.

This object is achieved by the independent patent claims. Advantageous embodiments are derived from the dependent claims.

In a first preferred embodiment, the invention relates to a system for replacing vertically segmented rotor segments on a rotary tablet press, consisting of a rotor, a receiving device and an assembly carriage.

The rotor of the rotary tablet press comprises in particular a rotor core and at least two rotor segments, wherein the rotor segments are formed by vertical segmentation of the rotor. In the sense of the invention, the term "vertical segmentation" means that the round rotor, whose base area forms a full circle of 360°, is subdivided preferably into rotor segments of equal size. Such a vertical segmentation is similar to that known from dividing a round pie into pieces of pie, each preferably being of the same size. Similarly, vertically segmented rotor segments are produced by dividing a round rotor ring into segments that are preferably of the same size. Vertical segmentation is to be differentiated in particular from horizontal segmentation in which individual rotor components, such as the upper and lower punch guides or die table, can be separated from one another. Such a method is described in WO 2009/112886 A1, for example.

In a view from above, the round rotor forms a circle. A rotor segment is delimited essentially by an external arc and two legs, as seen from above, wherein the legs represent the radii of the circle and together form an angle. The points of intersection of the two legs here correspond to the midpoint of the circle and/or of the rotor. The rotor core is centered around this midpoint. The rotor segments are mounted on the rotor core. Consequently, the vertically segmented rotor segments correspond only to essentially complete segments of a circle in the sense of the invention, because the tapering tip may be missing in the area of the imaginary point of intersection of the legs.

In the case of n rotor segments, the legs delimiting a rotor segment form an angle α as follows at their point of intersection:

$$\alpha = \frac{360°}{n}$$

The length s of the arc of the circle delimiting a rotor segment toward the outside at a number n of rotor segments amounts to $$s = \frac{2 \cdot \pi}{n},$$

where π represents the numerical ratio of a circle's diameter to its circumference.

The vertical segmentation of the rotor makes it possible to dismantle the individual rotor segments, segment by segment, from the rotary tablet press. Therefore, smaller weights must be moved per replacement operation, which greatly facilitates the handling of parts to be moved. In addition, the individual rotor segments are smaller than the rotor as a whole. According to the invention, they are dismantled in the same position in particular, namely between a pressure roll station and a removal device of the rotary tablet press. The rotor is situated rotatably in the rotary tablet press, so that after removal of a segment, it can be rotated further by an angle α, which permits dismantling of an additional rotor segment. The smaller arc length s of the segments makes it possible for upper and lower punch curves for controlling the upper and lower punches to remain in the rotary tablet press during the replacement. Therefore, the downtime of the press is shortened and the personnel cost is reduced because the installation and dismantling of the cams and the associated adjustment of the other components of the rotary tablet press are exactly what makes a substantial contribution to the total labor time in the rotor replacement, as described in the prior art.

It is advantageous if the rotor of the rotary tablet press comprises a rotor core, which is detachably centered and mounted on a drive flange. This rotor core can be dismantled easily in an advantageous manner. At least two rotor segments are mounted on the outer circumference of the rotor core. For weight reasons and for improved handling of the segments, in particular six identical segments may be used, thus forming the complete rotor. Despite this segmentation, the weight of the preferred rotor segment is in the range of 400 to 500 kg. It was completely surprising that it is possible to provide a system for replacing vertically segmented rotor segments, with which the handling of such large weights is made possible. Vertical segmentation makes it possible in particular for the weight of a rotor segment that is to be moved to be of an order of magnitude such that a preferred rotor segment can be transported using a transfer unit and can be taken over by a rotary segment carousel, which is adjustable in height, on an assembly carriage.

In another preferred embodiment, to lift a dismantled segment out of a rotary tablet press in a suitable operation, the system for replacing vertically segmented rotor segments comprises a transfer unit on which a rotor segment can be mounted automatically or manually by means of mounting screws and cylinder pins and/or other form-fitting and force-locking connecting means. The rotor segments can also be transferred by a suitable movement sequence to an assembly carriage by means of this transfer unit. It has been found to be advantageous to provide such a transfer unit to make the operation of the system according to the invention as simple as possible for an operator and to minimize the human effort that must be expended in replacing a segment.

The transfer unit advantageously comprises a receiving device for taking over a vertically segmented rotor segment, which is mounted so that it can slide on sliding and guiding rails and can be rotated, wherein the transfer unit can be mounted so that it is centered on a carrier plate of the rotary tablet press by means of a centering and mounting device and has a connecting device for connecting the transfer unit to the assembly carriage.

The receiving device is mounted on a base region of the transfer unit of sliding and guiding rails, so that it can slide. In particular the use of sliding and guiding rails permits a horizontal movement of the receiving device on these sliding and guiding rails, so that the receiving device can approach the rotor segment to be dismantled from the rotary tablet press and/or can be removed from it. In particular the sliding and guiding rails are arranged in such a way that they can also rotate and can follow the rotational movement of the receiving device.

If a vertical rotor segment is mounted on the receiving device of the transfer unit and if the rotor segment has been detached from the rotor core, then the receiving device can be moved away from the rotary tablet press on the sliding and guiding rails. Therefore, the rotor segment is removed a distance away from the rotary tablet press and a rotational movement of the receiving device becomes possible. The radius of the rotational movement is advantageously reduced by the returning the receiving device, and therefore the moment of inertia of the receiving device is also reduced, thereby reducing the force required to execute this rotational movement. To further facilitate the rotational movement, the transfer unit is preferably equipped with grips. In addition, a space-saving device for replacing segments is provided by the rotation of the receiving device in the retracted state with a minimal radius of the rotational movement.

It has been found to be advantageous that the transfer unit is simple to operate. The transfer unit is positioned on a rolling cart, for example, and is connected in a force-locking and/or form-fitting manner to the carrier plate of the rotary tablet press for replacing dies and/or changing segments.

In a preferred embodiment of the invention, this is done by using a centering and mounting device on the transfer unit, with which the transfer unit can be mounted and centered on a carrier plate of the rotary tablet press. In doing so, the transfer unit is brought close to the drive base of the rotary tablet press by means of the transport carriage and is brought up to the position provided for it in the vicinity of the rotary segment to be lifted out. The transfer unit is then centered, preferably by means of centering pins or angle brackets of a stable design and is preferably mounted on the carrier plate of the rotary tablet press by means of six mounting screws. It has proven advantageous to design these mounting screws to be very sturdy because the transport carriage is initially released after mounting the transfer unit on the rotary tablet press and then is removed completely, so that the preferred six mounting screws are sufficient to hold the weight of the transfer unit.

The rolling carriage is a height-adjustable transport carriage to adjust the transfer unit to the prevailing height of the respective carrier plate of the rotary tablet press as needed in this way and to mount it on the carrier plate. It has proven advantageous that the transport carriage is always moved in the lowered state in loading in order to minimize the risk of falling over.

In another preferred embodiment of the invention, the transfer unit comprises a connecting device for connecting the transfer unit to an assembly carriage. This connecting device permits a force-locking and/or form-fitting connection between the transfer unit and the assembly carriage, so that secure transfer of the rotor segments is ensured.

In another preferred embodiment of the invention, the system for replacing rotor segments comprises an assembly carriage. It is preferable for the assembly carriage to be equipped for accommodating at least one rotor segment. It is further preferred if the assembly carriage is designed to accommodate three segments. It was completely surprising that an assembly carriage for accommodating and storing the rotor segments according to the invention could also be made available for rotor segments of comparatively large rotary tablet presses, which are in the aforementioned weight range. This is made possible in particular by the vertical segmentation of the external rotor of the rotary tablet press and by the advantageous transfer of the rotor segment from the rotary tablet press to the assembly carriage by means of the preferred transfer unit.

In a preferred embodiment of the invention, the assembly carriage comprises in particular an adjustable-height rotary segment carousel for accommodating at least one rotor segment, wherein this adjustable-height rotary segment carousel is locked during transport in particular and not only when changing segments. Therefore, the assembly carriage includes a spring-mounted locking pin, which engages automatically in the locked position, with the detent mechanism is readily accessible from the outside.

In a particularly preferred embodiment of the invention, the segment carousel is adjustable in height and is designed to be rotatable. The height adjustment of the adjustable-height rotary segment carousel is achieved by the height adjustability of the axis of rotation of the segment carousel, which is implemented by means of a pressure screw with a lock nut, wherein the prevailing height can be read out by means of a vernier scale. The weight of the adjustable-height rotary segment carousel is carried primarily by an axial roller bearing.

The vertically segmented rotary segments are mounted on the adjustable-height rotary segment carousel by means of mounting screws which work together with boreholes in the rotor segments. Thus, the adjustable-height rotary segment carousel also has corresponding boreholes. It has been found to be advantageous that these mounting boreholes on the front side of the adjustable-height rotary segment carousel can be oriented in height and in the horizontal direction to the position of the corresponding boreholes in the vertically segmented rotor segments, which are present during the segment replacement process, mounted on the receiving device of the transfer unit.

In another preferred embodiment of the invention, it is advantageous that the assembly carriage is designed in particular to be tip-proof and to include, for example, two deflecting rollers, which can be used in particular for simpler transport. The preferred embodiment of the foot or bearing area of the assembly carriage in particular permits horizontal leveling of the assembly carriage, which may be advantageous for uneven ground conditions, for example. In a preferred embodiment of the invention, both manual and electric modes of operation of the assembly carriage are provided.

It was completely surprising that an assembly carriage could be made available which could accommodate a plurality of vertically segmented rotor segments at the same time and would nevertheless be lightweight and safe to operate. Due to the vertical segmentation, the preferred rotor segments have a weight suitable for transport by means of a preferred assembly carriage and transfer by a transfer unit.

The assembly carriage is connected frontally to the transfer unit in parallel in particular. This connection is implemented by means of a connecting device and permits rapid and safe setting of the assembly carriage on the transfer unit. The tools of a rotary tablet press are preferably protected from damage if they are dropped after being removed and positioned on the assembly carriage. The assembly carriage is particularly easy to clean because of its design, the material used and its properties.

With the present invention, it is preferable that the rotor segments are centered and mounted on the rotor core from the outside. Due to this arrangement of the rotor core and the rotor segments relative to one another, it is readily possible to release the rotor segments from the rotor core and dismantle them from the rotary tablet press. The construction of the present invention is advantageous in particular because the segments can be optimized with regard to the material thickness in order to reduce the weight of a segment by means of the stable and enclosed rotor core.

Furthermore, it is preferable for the rotor core for each rotor segment to include at least one guide, at least one centering, at least one supporting surface (supporting flange) and/or four threaded boreholes for mounting a vertically segmented rotor segment, wherein the threaded boreholes work together with preferably four mounting screws. By means of the guide, the attachment of a rotor segment onto the rotor core is greatly facilitated in that the rotor segment is brought into the correct position with respect to the rotor core. Precentering of the segment on the rotor core is performed by means of two bolts. In addition, in a preferred embodiment, the rotor core includes an additional centering element, which establishes the position of the rotor segment in the horizontal direction. The arrangement of the rotor segment on the rotor core in the vertical direction is ensured by the supporting surface or a supporting flange, on which the rotor segment rests at least in part, which provides an increased hold for the connection between the rotor segment and the rotor core. Mounting of the vertically segmented rotor segments on the rotor core is preferably accomplished by means of four mounting screws, which work together with four threaded boreholes in the rotor core. In particular in production processes, which cause a great deal of wear on tools and dies, for example, when pressing abrasive materials, the downtime of the rotary tablet presses due to the use of these elements can be greatly reduced.

It has been found to be advantageous that the segmented rotor corresponds, without restriction, to a one-piece rotor and/or a replaceable rotor in its functionality. In another preferred embodiment of the invention, the rotor has two to ten rotor segments, preferably four to eight, especially preferably six rotor segments. The vertical segmentation of the rotor reduces the weight to be moved in each case and facilitates the replacement of the rotor. The use of two to ten rotor segments, preferably four to eight, especially preferably six rotor segments is derived from the consideration that the individual rotor segments should be as light as possible, which indicates that a larger number of rotor segments should be used but, on the other hand, the number of individual segment replacement operations should not be unlimited, which would result in longer machine downtimes. The use of two to ten rotor segments, preferably four to eight, especially preferably six rotor segments has proven to be particularly advantageous in view of this consideration.

Because of the vertical segmentation, for example, it is possible to minimize the preparation work in replacing the segments and to achieve the least possible mounting and dismantling effort. It is advantageous that all the press stations and tablet discharge conduits need not be dismantled. Vertical segmentation of the rotor therefore permits rapid retooling of the rotary tablet press in particular. This reduced retooling time is derived in particular from the use of the system according to the invention, consisting of vertical rotor segmentation, transfer unit and assembly carriage, wherein the components of the system according to the invention intermesh with one another in such a way that retooling time is reduced to a greater extent than when, for example, only one component of the system would be usable and the individual theoretical time savings would be additive.

The respective segment can be replaced by rotating the rotor, preferably in the defined replacement position. In the case of six segments, for example, the rotor can be assembled completely with new segments having cleaned upper and lower punches and/or dies. The replacement time is much shorter than when each individual station had to be assembled with a new upper punch and/or lower punch. In particular in the case of a segmented replacement, additional components of the rotary tablet press, for example, the pressure stations, filling stations and the like need not be dismantled or pivoted outward. It was completely surprising that a rotary tablet press with these large dimensions could be made available, with which it would be possible for said components to remain in the rotary tablet press. This surprising effect is derived in particular from the cooperation of the vertical segmentation of the rotor, the transfer unit with the rotary and extractable receiving device and the assembly carriage with the adjustable-height rotary segment carousel. Thus, on the whole, less floor space is required by the rotary tablet press. Furthermore, fewer precautionary measures are needed for assemblies around the rotor. The individual segments are removed with the transfer unit in retooling in particular and placed on the assembly carriage. The upper and lower cams, in particular the filling and metering cams, remain on the rotor core in the machine. It was completely surprising that it would be possible to supply rotary tablet presses, in which the internal upper and lower punch cams could remain in the rotary tablet press during the segment replacement. In particular the cams are readily accessible and can be cleaned especially easily after dismantling the vertically segmented rotor segments, which are then transferred to the assembly carriage by means of the transfer unit for storage.

In addition, it was completely surprising that the upper and lower punches would be automatically threaded into the upper and lower punch cams after the segment replacement. This is achieved in particular by the fact that the cams are designed so that they consist of at least two components and can be opened due to the fact that they can remain in the rotary tablet press during the segment replacement. This makes it possible for the upper and lower punches and/or the rollers, with which they cooperate with the cams, to automatically enter the cam openings and then be ready for use again automatically when the cams are closed after the segment replacement is concluded.

For example, it has proven to be advantageous that the rotor consists of a rotor core with segments, including the upper punch and lower punch guides as well as the dies arranged around its outer circumference. These segments are detachably connected to the rotor core in a form-fitting and/or force-locking manner and/or are detachably connected to the neighboring segments in a form-fitting and/or force-locking manner. It is readily possible in this way to release and remove a single segment from the rotor core, preferably in a defined shutdown position of the rotor in the press. This segment is then preferably replaceable by another segment, which has new or reconditioned tools, i.e., top and/or lower punches and optionally dies and/or die inserts.

It is preferable for the rotor segment to include at least three parts arranged one above the other:

a. Upper punch guide
b. Intermediate ring to accommodate and mount replaceable die segments or an intermediate ring to accommodate and mount the replaceable die segments with a processed flange for mounting the central mandrel holders,
c. Guide for the lower punch.

It may preferably also be provided that the upper punch guide and the guide for the lower punch, i.e., the lower punch guide, are combined into one assembly. Furthermore, it is preferably provided that the individual segments have at least one subsegment, which is detachably connected individually to the segment. In this way, it is advantageously possible, for example, to separate only the dies and/or the rotor parts having die inserts in a segmented form from the rotor without having to remove the entire segment with the upper and/or lower punches. If the tool must be replaced more often that the dies or die inserts, then an optimized tool change can be performed thereby.

It is advantageous if the present invention includes in particular tools for a rotary tablet press, in which the shafts have dimensions up to diameters of 10 to 100 mm, for example, for the upper and lower punches, depending on the punch diameter. Even if greater filling depths are required, for example, 40 mm, 60 mm, 80 mm or 100 mm, this is covered by the present invention. With large shaft diameters and the working paths of the shafts corresponding to the lower punch filling depth and the upper punch immersion depth, the tools may be long (for example, 250 mm or longer) and heavy (for example, 5 kg or heavier). It was completely surprising that even such tools can be changed in the sense of the present invention and may be part of a segmented rotor.

It is also advantageous that tools, which are needed for manufacturing rings or ring-shaped press bodies, are also included. If ring-shaped press bodies using rotary tablet presses are produced instead of tablets, then a central mandrel and a central mandrel holder are required in addition. Rings or ring-shaped press bodies are required, for example, for alkaline batteries in the battery industry, for cleaning agents, catalysts, etc. The holder for the central mandrels is disposed beneath the die plate, but above the lower punch shaft guide. The lower punch shaft is lengthened accordingly by the central mandrel holder. Consequently, the height increases for the overall rotor package consisting of the upper punch shaft guide, the intermediate flange with the receptacle for the die table, the processed central mandrel holder and the lower punch shaft guide. It was completely surprising that tools for producing rings would also be accessible to faster tool changes due to the rotor segmentation and thus the downtime can be greatly reduced.

It has proven to be advantageous that with the present invention it is possible to increase efficiency. In the chemical and technical industries, the flow properties of the powders and granules to be processed necessitate narrow limits for the production rate. An increase in efficiency is possible by using larger machines with a larger number of tools and press stations. In the state of the art, however, the downtime for cleaning and changing tools is longer. With the present invention, the downtime in particular is reduced and the amount of productive time relative to the total time is improved.

It was completely surprising that an increase in efficiency could be achieved with the present invention to the extent that, despite larger machine dimensions, the time for a tool change is shortened and thus the downtime of the rotary tablet press is also shortened. Thus, the increased efficiency is achieved at the same machine speed/process speed by the fact that the number of tools in the rotor of the rotary tablet press is increased and/or additional press stations can be used. With respect to the tableting, this means that it is possible to increase efficiency at the same process speed. In the prior art, such an increase in the number of tools would be limited by the fact that the rotors would become to heavy with the press tools and thus rapid cleaning or a quick tool change would no longer be possible, but with the present invention, despite the larger dimensions, economic processes can be ensured because the rotor segments are replaceable.

The invention has contributed in particular to the fact that a considerable increase in efficiency can be achieved with a uniform process speed because of the machine size and preferred use of three press stations at the circumference, while nevertheless the downtime with very large machines can be reduced to 2 to 3 hours instead of more than 10 to 12 hours in comparison with the prior art. It was completely surprising that such a short retooling time could be achieved for vertically segmented rotors, which can be attributed to the very advantageous interaction of the vertical rotor segmentation, transfer by the transfer unit and use of the assembly carriage. The interaction of these individual factors yields a reduction in retooling time, which is even less than if only individual features of a rotary tablet press were implemented, and these fictitious individual time savings were added up. This is true in particular of the retention of the upper and lower punch cams in the rotary tablet press according to the invention, avoidance of dismantling press components such as filling stations or metering stations or pressure roller units mounted on the carrier plate of the rotary tablet press. This is made possible by using the transfer unit, and the use of such fastening means for fastening the vertically segmented rotor segments on the rotor core and on the adjustable-height rotary segment carousel of the assembly carriage.

It has thus proven to be advantageous that the segmented rotor consisting of vertically segmented segments according to the invention is not placed on the drive flange, centered and locked there by using a lifting mechanism, as in the case of a normal replaceable rotor, completely with the upper and lower cams, in particular the filling cams and metering cams and the press tools.

In a preferred embodiment, a rotor segment for mounting on the receiving device has three boreholes to receive mounting screws and two boreholes to receive cylinder pins, wherein the boreholes are arranged beneath the lower punch guide and work together with mounting screws and cylinder pins of the receiving device. The arrangement of these boreholes in the region of the lower punch guide ensures good reachability of the boreholes and the mounting means for humans of different body sizes. Due to the use of different types of mounting means, in particular mounting screws and cylinder pins, a particularly reliable and stable connection between the vertically segmented rotor segment and the receiving device of the transfer unit is ensured.

In another preferred embodiment of the invention, a rotor segment can be mounted by means of four mounting screws, both on the rotor core and on the adjustable-height rotary segment carousel. Due to the preferred use of the same mounting screws, a system for segment replacement is made available, which uses the smallest possible number of extra parts that must be kept on hand. This reduces acquisition costs and storage costs.

It is also preferably provided that the connecting device of the transfer unit with the assembly carriage is a quick-action lock formed by catch hooks on the transfer unit and recesses on the assembly carriage, wherein the catch hooks work together with the recesses. In the sense of this invention, the term "quick-action lock" refers to a clamping device which can be loosened or attached and tightened quickly by hand without using a tool. This is done by the fact that the catch hooks located on the transfer unit engage in recesses with which the assembly carriage is provided and thereby establish a force-locking and/or form-fitting connection between the transfer unit and the assembly carriage. Use of a quick-action lock is advantageous in particular due to the fact that no additional tool need be provided to establish this connection. In addition, it is advantageous that, in comparison with other fastening devices, a quick-action lock can be opened and closed quickly, which thus further reduces the total duration of the change operation.

The recesses in the assembly carriage are created in particular so that the catch hooks do not have to grip at a predetermined height, but instead the grip height is variable. Therefore, another means is made available for equalization of differences in height, so that uneven floor conditions can be counteracted. In addition, in a preferred embodiment, the connecting device includes a centering knob with which the position of the transfer unit relative to the assembly carriage is defined in the horizontal direction. This centering knob engages in an elongated centering slot in the vertical direction, so that the height adjustability of the transfer unit to the assembly carriage is also supported by this centering.

In another aspect, the invention relates in particular to a method for dismantling segments, including the following steps:

a. Opening the upper and lower punch cams in a removal position,
b. Positioning a transfer unit on a carrier plate of a rotary tablet press by means of a centering and mounting device,
c. Extending a receiving device of the transfer unit,
d. Mounting a vertically segmented rotor segment, which is situated on a rotor core on a receiving device by means of mounting screws and cylinder pins,
e. Releasing the rotor segment from the rotor core by loosening the mounting screws,
f. Extending the receiving device with the rotor segment thus removed,
g. Pivoting and/or shifting the receiving device with the rotor segment thereby removed,
h. Transfer of the rotor segment thereby removed by means of the receiving device to an adjustable-height rotary segment carousel of an assembly carriage,
i. Positioning and mounting the rotor segment thereby removed on the adjustable-height rotary segment carousel of the assembly carriage, wherein all the upper and lower punch cams remain in the rotary tablet press during a segment change.

In another aspect, the invention includes in particular a method for segment installation comprising the following steps:

a. Opening the upper and lower punch cams in a removal position,
b. Positioning a transfer unit on a carrier plate of a rotary tablet press by means of a centering and mounting device,
c. Mounting a vertically segmented rotor segment, which is situated on an adjustable-height rotary segment carousel on an assembly carriage, on a receiving device of the transfer unit by means of mounting screws and cylinder pins,
d. Transfer of the rotor segment by means of the receiving device from the adjustable-height rotary segment carousel of the assembly carriage,
e. Pivoting and/or shifting the receiving device with the rotor segment,
f. Retracting the receiving device of the transfer unit with the rotor segment,
g. Positioning and mounting the rotor segment on the rotor core by means of mounting screws,
h. Closing the upper and lower punch cams, wherein all the upper and lower punch cams remain in the rotary tablet press when changing segments.

It was completely surprising that it is possible to provide a method in which the upper and lower punch cams can remain in the rotary tablet press. This makes it possible for the internal upper and lower punch cams of the rotary tablet press to be openable, so that the vertically segmented rotor segments can be installed and dismantled in a removal position. The upper and lower punch curves of the rotary tablet press are in particular the filling and metering cams of the rotary tablet press. Due to the use of the vertically segmented rotor segments, it is possible in particular for these upper and lower punch cams to remain in the rotary tablet press during replacement of a segment and they need not be removed. This shortens the downtime of the rotary tablet press and avoids tedious adjustment processes.

The transfer unit on a carrier plate of a rotary tablet press is positioned in such a way that the transfer unit is first brought up to the rotary tablet press by means of a height-adjustable transport carriage. It has proven to be advantageous that the transport carriage is moved only when lowered in order to prevent the carriage from falling over. The storage area of the transport carriage on which the transfer unit is located is then adapted to the height of the carrier plate of the rotary tablet press by means of the height adjustment of the transport carriage. This makes it possible to shift the transfer unit at least partially onto the carrier plate of the rotary tablet press. By means of the centering and mounting device, the transfer unit is then brought into the preferred defined position and mounted on the carrier plate by using six mounting screws. It has proven to be advantageous to design this mounting to be as sturdy as possible to ensure a secure connection between the transfer unit and the carrier plate. The transport carriage is then removed from the rotary tablet press.

The receiving device of the transfer unit is then extended. Extending and returning in the sense of this invention refer to the horizontal movement of the receiving device on the sliding and guiding rails of the transfer unit provided for this purpose. These permit a back-and-forth movement in the horizontal direction, which is referred to in the sense of this invention as extending and returning the receiving device. Due to being extended, the receiving device is moved toward the rotary segment to be replaced in particular, whereas returning causes it to move away.

The receiving device of the transfer unit is designed in particular to be rotational. The rotational movement is implemented about an axis of the receiving device. Due to the receiving device being extended and returned, the radius of this rotational movement is changed in particular. This is advantageous in particular because a small turning radius leads to a small moment of inertia and thus to a low force to be applied for the rotational movement. In addition, returning the receiving device in the loaded state makes possible the rotational movement of the receiving device at all because the vertically segmented rotor segment must first be removed from the rotor core by this return in order to create enough space for the rotational movement.

The receiving device is mounted on a vertically segmented rotor segment after being extended by means of mounting screws and cylinder pins. To do so, boreholes with which the mounting screws and cylinder pins cooperate are provided in the region of the lower punch guide of the rotor segment. The arrangement of the boreholes in the lower region of a rotor segment ensures that humans of a small height in particular will be able to establish the mounting connection between the receiving device and the rotor segment.

Next, the vertically segmented rotor segment to be dismantled is released from the rotor core by loosening preferably four mounting screws, which establish the connection between the rotor segment and the rotor core.

In another preferred embodiment of the method, the rotor segments are mounted on the rotor core using the same fastening means as the mounting of the rotor segments on the adjustable-height rotary segment carousel of the assembly carriage. Due to this design, the number of extra parts to be kept on hand is reduced and storage costs are eliminated. Furthermore, this simplifies the segment replacement procedure.

After loosening the vertically segmented rotor segment from the rotor core, the receiving device is returned. The rotor segment is therefore removed from the rotary tablet press and enough space is created, so that the receiving device can be rotated or pivoted. Due to the rotation or pivoting about an axis of rotation, the receiving device is in the region of the adjustable-height rotary segment carousel of the assembly carriage. Due to shifting on the sliding and guiding rails of the receiving device, the vertically segmented rotor segment can then be brought into proximity of a free position of the adjustable-height rotary segment carousel. It was completely surprising that, by using the system according to the invention, such a space-saving and time-saving method for changing segments could be made available.

The vertically segmented rotor segment is then transferred to the adjustable-height rotary segment carousel of the assembly carriage and the rotor segment removed from the rotary segment press is positioned and mounted on the adjustable-height rotary segment carousel of the assembly carriage. This is done by means of the same mounting means as the mounting of the rotor segment on the rotor core, wherein the adjustable-height rotary segment carousel has suitable boreholes to receive these mounting means in particular. Due to the rotational and adjustable-height design of the segment carousel, a horizontal and vertical alignment of the corresponding boreholes on the vertically segmented rotor segment and on the segment carousel is made possible in particular.

The segment is installed essentially due to the fact that the process steps that have been described take place in the reverse order when dismantling of the segment. Performing the procedure is greatly facilitated for the operator due to the reversibility of this process. The error proneness of the segment change is reduced in particular.

An important feature of the method described here for the segment change is that the upper and lower punch curves remain in the rotary tablet press during the segment change. These are in particular control curves, filling curves and metering curves. The fact that the curves remain in the rotary tablet press is advantageous in particular due to the fact that the segment change is greatly facilitated in this way and can be performed more quickly. In particular, no complicated readjustment of tools is required. This is an important difference in comparison with the methods and devices described in the prior art for changing rotors or rotor segments or die segments. It was completely surprising that the retention of the curves in the rotary tablet press can be enabled for large segment rotors during the retooling.

In another preferred embodiment of the method, the inner upper and lower punch cams on the inside of the rotary tablet press are opened up manually or automatically when a segment is installed as well as when segment is dismantled for removing and installing the vertically segmented rotor segments using the press tools. This flexible design of the method supports the different profiles of requirements in different areas of use of the rotary tablet press and permits the optimized process application.

It is also preferable that the upper and lower punch tools are threaded into the cams automatically when the rotor segments are removed and installed. This is achieved by the fact that the cams can be divided into two parts horizontally. In the assembled state, the two cam parts form a U-shaped component, wherein the opening in the "U" points in the direction of the punch tools. These punch tools are equipped with rollers, which work together with the U-shaped opening in the cams and facilitate control of the press tools by the cams.

In changing segments, the punch tools are extracted from the cams and are held only by a center mandrel holder. In doing so, the rollers of the lower punch, for example, are shifted downward a small distance. Due to the horizontal separation of the cam components, the U-shaped opening in the cams is enlarged and in particular the opening is also shifted downward. When the punch tools are then moved toward the cam, the rollers on the punches can re-enter the U-shaped opening in the cam. When the two cam components are then reconnected to one another, the punch tools are also back in the position established for them for the production process. This automatic threading significantly facilitates the segment changing operation and also makes a significant contribution toward reducing the total time for the changing operation.

In another preferred embodiment of the method, the receiving device is extended or returned by a linear adjusting and/or resetting movement on the sliding and guiding rails, wherein the adjusting and/or restoring movement is either performed manually by means of a hand wheel or is automated. In a preferred embodiment, the transfer unit is equipped with a hand wheel. This hand wheel has a rack-and-pinion mechanism with which the radial movement of the hand wheel is converted into a linear movement of the receiving device by an impinging spindle drive. This linear adjusting and/or restoring movement represents the extended and return of the receiving device in the horizontal direction on the sliding and guiding rails, with which the receiving device can be moved toward or away from the rotary tablet press or the adjustable-height rotary segment carousel.

It is advantageous if, in a segment change by using the system according to the invention, there is no physical burden on the operator at all. For example, a horizontal lift of the transfer unit may be accomplished by a spindle drive or by a rod drive. In particular this permits manual, motor-driven, pneumatic or hydraulic operation of the transfer unit. The transfer unit can in particular safely accept up to 500 kg, for example, from the rotary tablet press and transfer it to the assembly carriage.

In another preferred embodiment, this movement may also be implemented with automatic hydraulic or electric drives, for example. In particular any type of manual or automatic drive may be used. This is advantageous if the use of labor forces is to be minimized.

In another preferred embodiment of the invention, the rotational movement of the receiving device can also be implemented in an automated process. In particular the rotational movement of the receiving device is a damped movement, this damping being implemented by an oil brake. This limits the rotational speed that can be achieved, in that the force to be applied for the rotational movement increases with an increase in the rotational speed.

In another preferred embodiment of the method, the mounting of the transfer unit on the carrier plate of the rotary tablet press is provided in a defined position, in particular between a pressure rolling station and a removal device. A pressure rolling station in the sense of the invention is a column-shaped device for receiving upper and a lower pressure rollers, which compress the punch tools for the purposes of producing the pressed body. A removal device in the sense of the invention is a device in the area of which the press bodies that are produced can exit from the rotary tablet press. This is accomplished by means of a coasting wheel, which rotates in synchronization with the rotor of the rotary tablet press and transfers the finished pressed bodies to a conveyor element or a conveyor chute. It is advantageous that these peripheral conveyor elements on the exterior and the coasting wheel need not be dismantled or removed when changing segments but instead remain in the rotary tablet press. The rotatable rotor of the rotary tablet press is rotated further after dismantling a vertically segmented rotor segment and is brought into a position, such that the next segment can be removed by the transfer unit. In addition, it is advantageous that in the defined position of the transfer unit on the carrier plate of the rotary tablet press, only one set of boreholes need be provided for the mounting means in the carrier plate, which reduces the cost of manufacturing the carrier plate.

The vertically segmented rotor segments can be serviced, cleaned and assembled with new tools more easily outside of the rotary tablet press. Because of their size, they can also be sent to a washing machine or an industrial washing machine.

The invention will now be described in greater detail on the basis of the figures as examples. The examples and figures relate to preferred embodiment variants, which do not restrict the invention.

Figure 1:
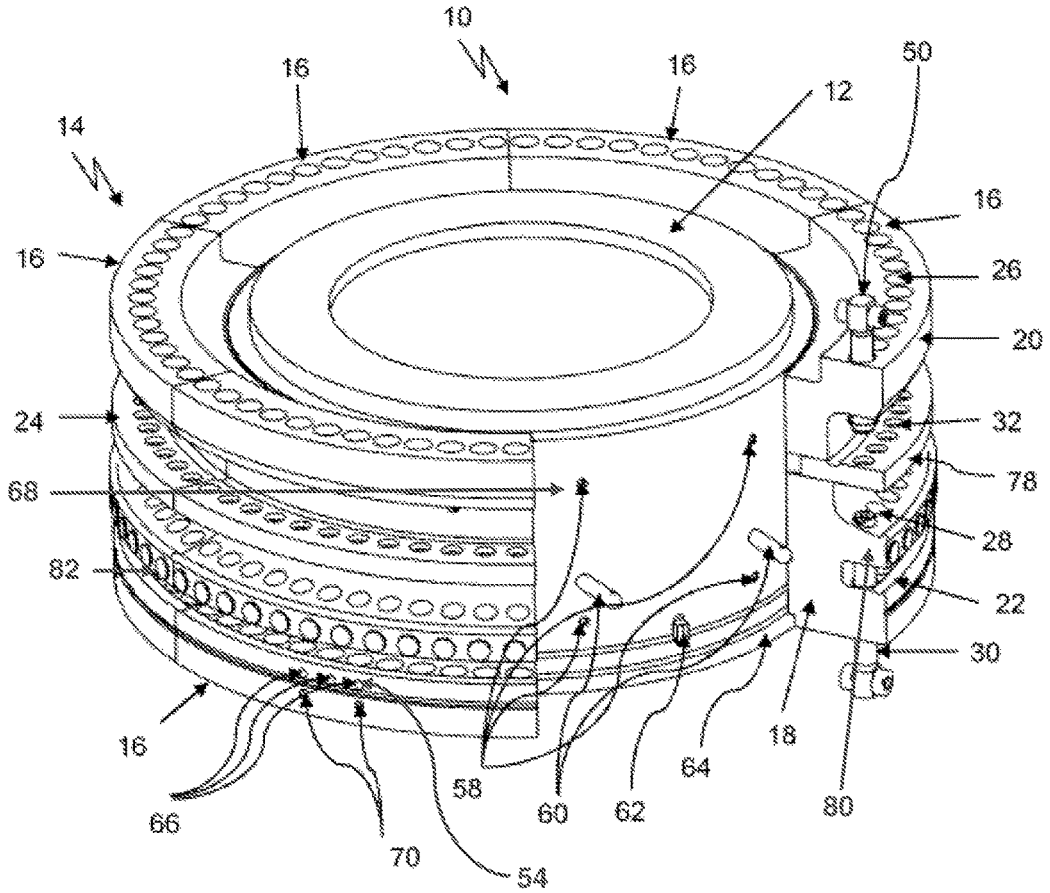
FIG. 1 shows a schematic perspective view of a rotor of a rotary tablet press comprised of vertically segmented rotor segments.

FIG. 1 shows, in a schematic perspective view, a rotor labeled with reference numeral 10 as a whole as part of rotary tablet press 34. The design and function of rotary tablet presses are sufficiently familiar to those skilled in the art, so they need not be described further here within the context of this description. The rotor 10 can be induced to rotate by means of a drive. In this way, upper punches 50 and lower punches 30 arranged around the circumference of the rotor 10 are brought past various fixedly arranged stations. These stations are filling stations, prepress stations, main press stations, ejection stations and the like. A die into which the material to be pressed is cast is assigned to each pair of an upper punch and a lower punch. The upper punch 50 and the lower punch 30 are guided by guide cams into the dies, so that the material introduced there is pressed. Such rotary tablet presses can be used for production of tablets, for example, but also for production of technical products, for example, pressed rings for manufacturing batteries.

The rotor 10 comprises a rotor core 12, which is connected to a drive device for a rotor 10 by means of connecting elements (not shown in detail). An external rotor, labeled with reference numeral 14 on the whole, is arranged around the rotor 10. The external rotor 14 comprises a plurality of rotor segments 16, each rotor segment 16 spanning a pitch circle. According to the exemplary embodiment shown here, six rotary segments 16 are provided, each bridging a pitch circle of 60°. This means that the legs, which delimit a rotor segment, together form a 60° angle. The rotor segments 16 can be connected to the rotor core 12 in a form-fitting and/or force-locking manner. Four mounting screws 54, which work together with boreholes 58 in the rotor core, are therefore provided for each rotor segment. In addition, the rotor segments 16 may also be connected to the front sides 18 running radially in a form-fitting and/or force-locking manner. The rotor segments 16 may also be mounted by means of quick-change elements or the like, for example.

The diagram in FIG. 1 shows a total of five rotor segments 16, wherein the sixth rotor segment 16 has been removed. This illustrates the fact that the rotor segments 16 can each be removed individually from the rotor core 12. The connection between the rotor segments 16 and the rotor core 12 is formed by the mounting screws 54, which work together with the boreholes 58, so that they are also arranged in dimensionally stable and positionally stable positions with respect to the rotor core 12 and the neighboring rotor segments 16 during operation of the rotary tablet press 34.

In the diagram in FIG. 1, it is also clear that the rotor segments 16, which form the external rotor 14 on the whole, include an upper punch guide 20, a lower punch guide 22 and a die region 24. Due to the segmentation of the external rotor 14, the die table is also in the form of die segments 78. The upper punch guide 20 has guides 26 for the upper punches 50 in an essentially known manner. The lower punch guide 22 has guides 28 for the lower punches 30 shown here as an example. The die region 24 has die openings 32. One guide 26 and one guide 28 are flush with a die opening 32, so that the upper punch 50 and the lower punch 30 can be shifted radially toward one another in pairs over guide cams (not shown), so that material to be pressed can be filled into the die opening 32.

Inside the rotor segments 16, it is possible to provide that dies and/or die inserts are present for different press formats, i.e., several different tablet shapes.

As shown in FIG. 1, each rotor segment 16 has a number of guides 26 and 28 and/or die openings 32. According to the example shown here, twelve guides 26, 28 and die openings 32 are provided per segment 16. According to additional exemplary embodiments not shown here, the number of rotor segments 16 as well as the number of guides 26, 28 and die openings 32 per rotor segment 16 can of course also be selected differently. The number of rotor segments 16 may be an even or an odd number. The rotor segments 16 may be divided uniformly or nonuniformly.

The segmentation of at least the external rotor 14 offers a possibility that the rotor segments 16 can be dismantled individually from the rotor core 12. At the same time, the upper punch 50 and the lower punch 30 are removed with the dismantling. The dismantled rotor segment 16 can be replaced by a new rotor segment 16, which then has new or reprocessed upper punches 50 and lower punches 30. By proceeding incrementally, namely in six increments according to FIG. 1, it is thus possible to replace all six rotor segments 16 with the tools arranged therein within a relatively short period of time. The retooling time for the entire rotor 10 can thus be kept relatively short.

FIG. 1 additionally shows the boreholes 66 and 70 for the mounting screws 68 and cylinder pins 72, with which a vertically segmented rotor segment 16 can be mounted on a receiving device 48. According to the invention, these are located in the region of the lower punch guide 22.

In addition, FIG. 1 shows the means with which the vertically segmented rotor segments 16 are centered on the rotor core 12. This is done in a vertical direction by means of a supporting surface 64 on which the rotor segment 16 rests at least partially. Centering in the horizontal direction is accomplished by the centering segment 62, which works together with a recess (not shown) on the inside of the rotor segment 16. This figure also shows centering pins 60, which enable precentering of the rotor segments 16 during installation of the segments 16 on the rotor core 12.

Figure 2:
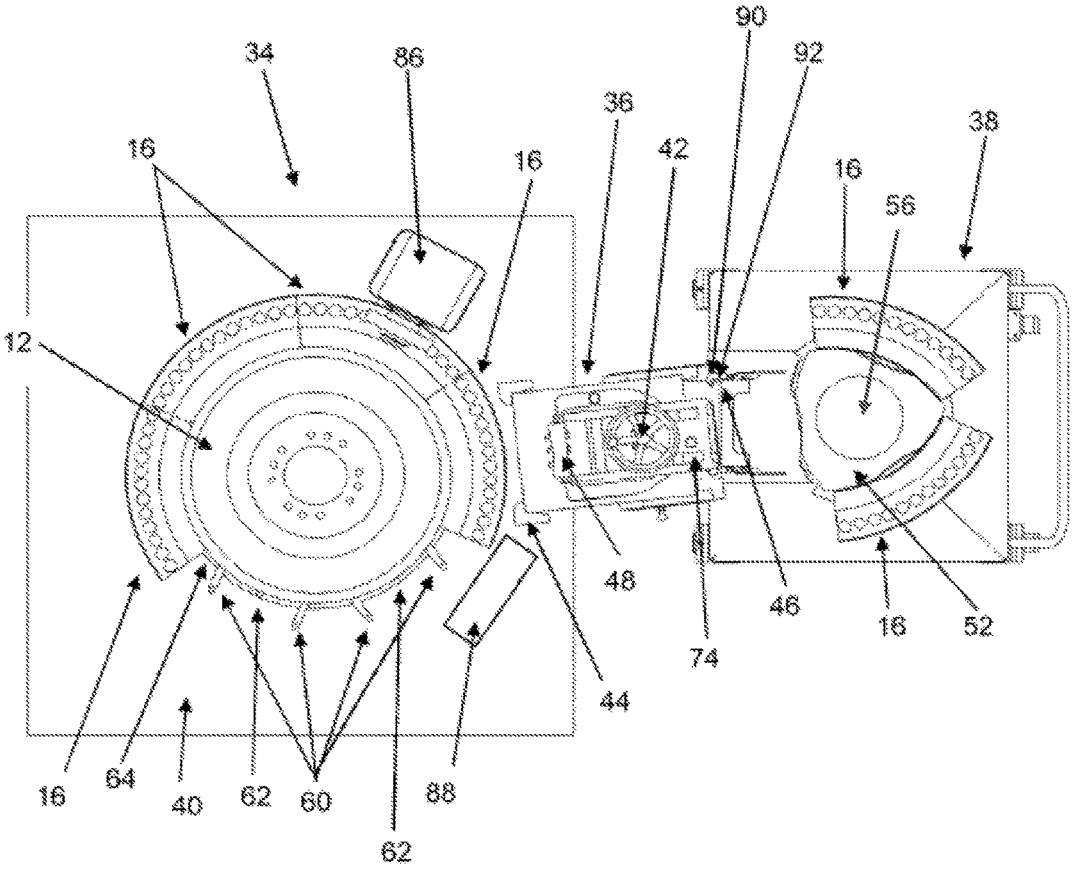
FIG. 2 shows a schematic diagram of a rotary tablet press with a rotor comprised of vertically segmented rotor segments, a transfer unit and an assembly carriage in a starting position.

FIG. 2 shows a preferred arrangement of the rotary tablet press 34, the transfer unit 36 and the assembly carriage 38. The transfer unit 36 is in a starting position here. This means that the receiving device 48 of the transfer unit 36 is not extended or pivoted. In this position, the transfer unit 36 is mounted on the carrier plate 40 of the rotary tablet press 34 and on the assembly carriage 38. Then the receiving device 48 can be extended and thereby brought into the vicinity of the rotor segment 16 to be dismantled from the rotary tablet press 34.

It has proven to be advantageous if, for the segment change, the transfer unit 36, which is pivotable, for example, is used as a peripheral module for removal of the rotor segments 16 of the rotary tablet press 34. This device is placed with a lifting mechanism on the carrier plate 40 of the rotary tablet press 34, for example, in a predefined position for the segment removal and is mounted there. To do so, the transfer unit 36 comprises a centering and mounting device 44. Mounting of the transfer unit 36 on the carrier plate 40 of the rotary tablet press 34 is accomplished by means of six mounting screws, for example. The receiving device 48 can be extended manually or by motor drive to receive the rotor segment 16. To do so, the receiving device 48 is supported on sliding and guiding rails 74, on which the receiving device 48 executes a horizontal adjusting and/or resetting movement, which is referred to as extending or returning in the sense of the invention. The vertically segmented rotor segment 16 is therefore mounted on the receiving device 48 by means of three mounting screws 68 and two cylinder pins (not shown), for example. Next, the mounting screws 54, which secure the vertically segmented rotor segment 16 on the rotor core 12, are loosened. The receiving device 48 is returned to a central starting position with a minimal turning radius. This creates space for a pivoting or rotational movement for the first time, and the force to be applied for the rotational or pivoting movement is reduced due to the reduction in the turning radius. Next, the device is pivoted 180° outward, for example. The assembly carriage 38 stands in the outside position of the receiving device 48.

The pivotable top part of the assembly carriage 38 forms a height-adjustable rotational segment carousel 52 and has three segment receptacles, for example, which are arranged at an angle of 120°. The distance of the assembly carriage 38 from the rotary tablet press 34 is predefined in particular by the fixed connection of the transfer unit 36 to the assembly carriage 38. The transfer unit 36 is connected in a force-locking and/or form-fitting connection to the assembly carriage 38 and/or to the carrier plate 40 of the rotary tablet press 34 during the segment removal, the segment installation, the segment change and/or the tool change. When the receiving device 48 of the transfer unit 36 is in the 180° rotated position, the receiving device 48 is extended into the final position and the rotor segment 16 is mounted in the first segment position of the height-adjustable rotational segment carousel 52 of the assembly carriage 38 using four mounting screws 54, for example. The four mounting screws 54 are preferably the same screws with which the vertically segmented rotor segment 16 is also mounted on the rotor core 12.

This process can be repeated many times, depending on the number of positions on the assembly carriage 38 and the number of rotor segments 16. To do so, the respective empty acceptance positions of the assembly carriage 38 are pivoted into the receiving position. When the assembly carriage 38 is completely occupied, it can be replaced by an empty assembly carriage 38. For example, six dismantling steps and three assembly carriages 38 are needed for an assembly carriage 38 having room for two rotor segments 16 and one rotor 10 with six rotor segments 16.

When all the rotor segments 16 have been dismantled, of the complete segmented rotor 10, only the rotor core 12 and the upper and lower cams, which are in particular guide curves, filling cams and dosing cams with the corresponding dust suction nozzles are situated in the rotary tablet press 34. It can be seen as a major advantage in a segment change that all the cams remain in the rotary tablet press 34. The upper and lower cams in the removal position are opened automatically, so that the heads of the upper and lower shafts of the upper punches 50 and the lower punches 30 together with the rolls can be removed easily from the cams together with the rotor segments 16. Next, the suction hoses and suction nozzles are dismantled. Then the entire interior of the machine and the upper and lower cams are cleaned thoroughly.

In preparation for installation of six rotor segments 16, for example, in the rotary tablet press 34, two assembly carriages 38 can be made available each with three cleaned rotor segments 16 fitted with clean and functional tools. The six cleaned rotor segments 16 can be installed, for example, one after the other into the rotary tablet press 34 with the transfer unit 36 for segment installation. Next, the suction hoses, suction nozzles, filling devices and material feed are installed. The rotary tablet press 34 is again ready to use. The retooling time from stop to start of the rotary tablet press 34 can be estimated at two hours to at most three hours, which represents a substantial shortening in comparison with retooling times of ten to twelve hours, which have been described in the prior art, and normally two employees are needed to retool a conventional press. Therefore, this method is extremely efficient in particular because the employees need not move any large weights manually.

FIG. 2 also shows that the transfer unit 36 is mounted on the carrier plate in a fixed position on the rotary tablet press 34. This is done by means of the centering and mounting device 44. The established position for mounting the transfer unit on the carrier plate 40 is situated in particular between a pressure roller station 86 and a removal device 88, with which finished pressed bodies are removed from the rotary tablet press 34. Due to the use of the vertically segmented rotor segments 16, these need not be dismantled when the rotor 14 is replaced.

The receiving device 48 can be moved horizontally on sliding or guiding rails 74. This can be implemented either manually with the help of a hand wheel 42 or in an automated process. The radial movement of the hand wheel 42 is converted into linear movement of the receiving device 48 by means of a rack and pinion mechanism.

The transfer unit 36 is connected to the carrier plate 40 of the rotary tablet press 34 as well as to the assembly carriage 38 during the segment change operation. The connection to the assembly carriage 38 is implemented by means of a connecting device 46, which is designed as a quick-action lock, for example. Catch hooks 90 provided on the assembly carriage 38 grip in recesses 92 in the transfer unit 36. The recesses 92 in the transfer unit 36 are in particular designed, so that the connection between the assembly carriage 38 and the transfer unit 36 is not limited to a fixed height but instead, due to the design of the recesses 92, unevenness in the floor in particular can be compensated.

FIG. 2 also shows the centering elements 62, which are present on the rotor core 12 for each rotor segment 16 as well as the supporting surface and/or the supporting flange 64.

Due to these components of the rotor core 12, the vertically segmented rotor segments 16 are centered in vertical and horizontal directions during installation.

Figure 3:
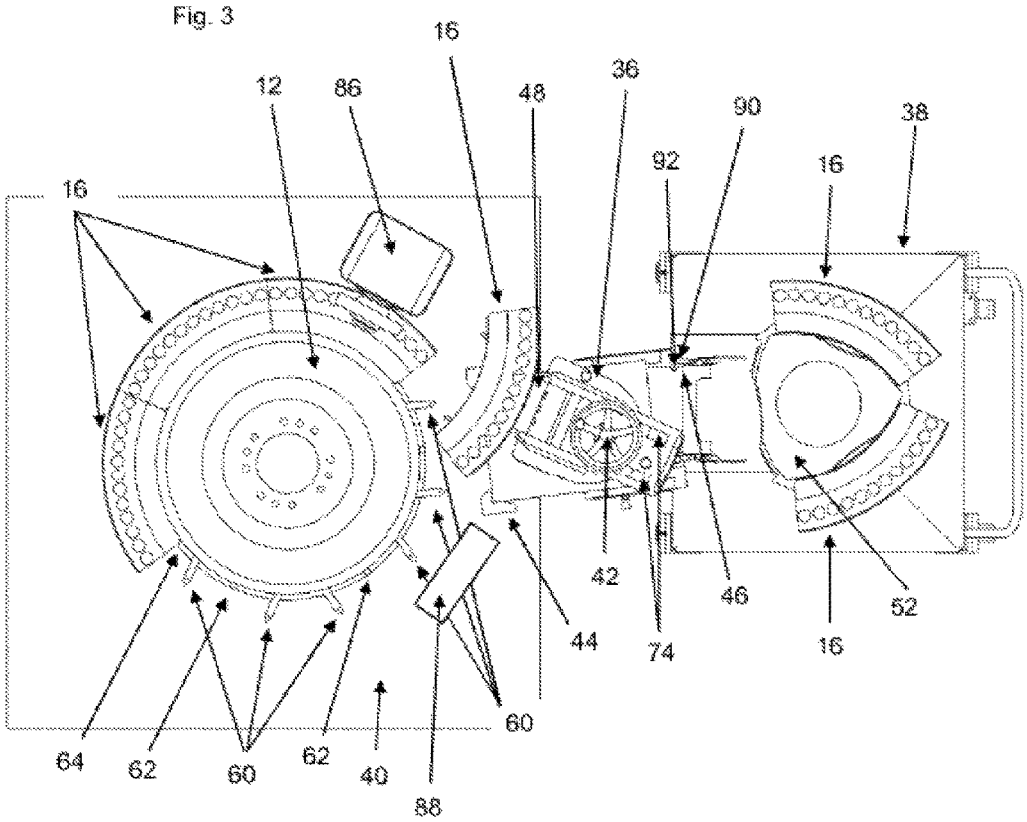
FIG. 3 shows a schematic diagram of a rotary tablet press with a rotor comprised of vertically segmented rotor segments, a transfer unit and assembly carriage during the segment replacement operation.

FIG. 3 shows the inventive system of rotary tablet press 34 with vertically segmented rotor segments 16, transfer unit 36 and assembly carriage 38 during the segment change operation. The rotor segment 16 to be dismantled is then placed on the receiving device 48 of the transfer unit 36 and is rotated to the adjustable-height rotary segment carousel 52 using the pivotable receiving device 48.

LIST OF REFERENCE NUMERALS

10 Rotor
12 Rotor core
14 External rotor
16 Vertically segmented rotor segments
18 Front side of the vertically segmented rotor segments 16
20 Upper punch guide
22 Lower punch guide
24 Die region
26 Guide
28 Guide
30 Lower punch
32 Die openings
34 Rotary tablet press
36 Transfer unit
38 Assembly carriage
40 Carrier plate
42 Hand wheel
44 Centering and mounting device for transfer unit (36) on carrier plate (40)
46 Connecting device for mounting the transfer unit (36) on the assembly carriage (38), in particular a quick-action lock
48 Receiving device
50 Upper punch
52 Height-adjustable rotary height-adjustable rotary segment carousel
54 Mounting screws for mounting the rotor segments on the rotor core and the height-adjustable rotary adjustable-height rotary segment carousel
56 Axis of rotation of the receiving device
58 Boreholes for mounting screws (54)
60 Guide on the rotor core (12) for guiding the rotor segments (16)
62 Centering on the rotor core (12) for centering the rotor segments (16)
64 Supporting surface or supporting flange
66 Boreholes for mounting screws (68)
68 Mounting screws
72 Cylinder pins
74 Sliding and guiding rails of the receiving device
78 Die segments
80 Intermediate ring for producing ring-shaped press bodies
82 Mounting flange
86 Pressure roller station
88 Removal device
90 Catch hook of the quick-action lock
92 Recesses in the quick-action lock

The invention claimed is:

1. A system for changing vertically segmented rotor segments on a rotary tablet press, comprising:

a rotor having a base area that forms a full circle, a transfer unit, and an assembly carriage, wherein the rotor comprises a rotor core and at least two rotor segments, wherein the rotor segments constitute vertical segments of the rotor, and the transfer unit comprises a receiving device for gripping a rotor segment, the receiving device being mounted slidably on sliding and guiding rails and is rotatable, wherein the transfer unit (i) is adapted to be mounted and centered via a centering and mounting device on a carrier plate of the rotary tablet press and (ii) has a connecting device for connecting the transfer unit to the assembly carriage, and the assembly carriage comprises ao a height-adjustable rotary segment carousel which is adapted to accommodate at least one rotor segment, wherein the assembly carriage is adapted to be connected to the transfer unit via the connecting device.

2. The system according to claim 1, wherein the rotor segments are centered from the outside and mounted on the rotor core, and the rotor core comprises, for each rotor segment, at least one guide, at least one centering, at least one supporting surface and/or four threaded boreholes for mounting a vertically segmented rotor segment, wherein the threaded boreholes work together with four mounting screws.

3. The system according to claim 1, wherein the rotor has two to ten rotor segments.

4. The system according to claim 3, wherein the rotor has four to eight rotor segments.

5. The system according to claim 3, wherein the rotor has six rotor segments.

6. The system according to claim 1, wherein the vertically segmented rotor segments comprise each at least three parts that are vertically stacked.

7. The system according to claim 6, wherein the at least three parts which are vertically stacked comprise:

a) a guide for the upper punch, b) an intermediate ring accommodating and mounting replaceable die segments and adapted to produce solid tablets or an intermediate ring accommodating and mounting replaceable die segments with a processed flange adapted to mount central mandrel holders which are adapted to produce ring-shaped press bodies, and c) guidance for lower punches.

8. The system according to claim 1, wherein the at least two rotor segments comprise at least one rotor segment for mounting on the receiving device that has three boreholes adapted to accommodate mounting screws and two boreholes adapted to accommodate cylinder pins, wherein the boreholes are arranged beneath the guide for lower punches and are adapted to work together with mounting screws and cylinder pins of the receiving device.

9. The system according to claim 1, wherein the rotor segments are adapted to be mounted on the rotor core as well as on the height-adjustable rotary segment carousel via four mounting screws.

10. The system according to claim 1, wherein the connecting device connecting the transfer unit with the assembly carriage is a quick-action lock, which is formed by catch hooks on the transfer unit and recesses on the assembly carriage, and wherein the catch hooks work together with the recesses.

11. A method for segment dismantling of a rotary tablet press via the system of claim 1, comprising:

a) opening upper and lower punch cams of the rotary tablet press into a removal position, b) positioning the transfer unit on the carrier plate of the rotary tablet press via the centering and mounting device, c) extending the receiving device of the transfer unit, d) mounting one of the vertically segmented rotor segments situated on the rotor core on the receiving device, e) releasing the rotor segment from the rotor core, f) returning the receiving device with the rotor segment thereby removed, g) pivoting and/or shifting the receiving device with the rotor segment thereby removed, h) transferring the rotor segment thereby removed via the receiving device to the height-adjustable rotary segment carousel of the assembly carriage, i) positioning and mounting the rotor segment thereby removed on the segment carousel of the assembly carriage, wherein all the upper and lower punch cams remain in the rotary tablet press during the segment change.

12. The method according to claim 11, wherein upper and lower punch curves open automatically or manually to remove and install rotor segments in the area of the rotor segment removal.

13. The method according to claim 12, wherein upper and lower punches are automatically threaded into the upper and lower punch cams during dismantling and installation of the rotor segments.

14. The method according to claim 11, wherein upper and lower punches are automatically threaded into the upper and lower punch cams during dismantling and installation of the rotor segments.

15. The method according to claim 11, wherein the removal extension or return of the receiving device is implemented by a linear adjusting movement on the sliding and guiding rails, wherein the adjusting movement is implemented either manually by means of a hand wheel or by automation.

16. The method according to claim 11, wherein the mounting of the rotor segments on the rotor core and adjustable-height rotary segment carousel takes place using the same mounting means.

17. The method according to claim 11, wherein mounting of the transfer unit on the carrier plate of the rotary tablet press is provided between a pressure rolling station and a removal device.

18. A method for segment installation for a rotary tablet press via the system of claim 1, comprising:

a) opening upper and lower punch cams in a removal position, b) positioning the transfer unit on the carrier plate of the rotary tablet press via the centering and mounting device, c) mounting one of the vertically segmented rotor segments, which is situated on the-height-adjustable rotary segment carousel onto the assembly carriage, on the receiving device of the transfer unit, d) receiving the rotor segment via the receiving device from the segment carousel of the assembly carriage, e) pivoting and/or shifting the receiving device with the rotor segment, f) extending the receiving device of the transfer unit with the rotor segment, g) positioning and mounting the rotor segment on the rotor core via mounting screws, h) closing the upper and lower punch cams, wherein all the upper and lower punch cams remain in the rotary tablet press during the segments change.

19. The method according to claim 18, wherein upper and lower punch curves open automatically or manually to remove and install rotor segments in the area of the rotor segment removal.

20. The method according to claim 18, wherein upper and lower punches are automatically threaded into the upper and lower punch cams during dismantling and installation of the rotor segments.

* * * * *